US009221629B1

(12) United States Patent
Sands et al.

(10) Patent No.: US 9,221,629 B1
(45) Date of Patent: Dec. 29, 2015

(54) FRICTION FEEDER

(71) Applicant: Superior Paper Handling Solutions, Inc., Plymouth, MN (US)

(72) Inventors: Steven G. Sands, Plymouth, MN (US); Joseph R. Lacher, Zimmerman, MN (US)

(73) Assignee: SUPERIOR PAPER HANDLING SOLUTIONS, INC., Plymouth, MN (US)

( * ) Notice: Subject to any disclaimer, the term of this patent is extended or adjusted under 35 U.S.C. 154(b) by 76 days.

(21) Appl. No.: 13/835,412

(22) Filed: Mar. 15, 2013

Related U.S. Application Data

(60) Provisional application No. 61/707,254, filed on Sep. 28, 2012.

(51) Int. Cl.

| | |
|---|---|
| ***B65H 3/06*** | (2006.01) |
| ***B65H 3/52*** | (2006.01) |
| ***B65G 59/00*** | (2006.01) |
| ***B65H 3/04*** | (2006.01) |

(52) U.S. Cl.
CPC ..... *B65G 59/00* (2013.01); *B65H 3/042* (2013.01); *B65H 3/063* (2013.01); *B65H 3/5238* (2013.01)

(58) Field of Classification Search
CPC ..... B65H 3/042; B65H 3/5238; B65H 3/063
USPC ..... 271/35, 165, 167, 124, 171, 121
See application file for complete search history.

(56) References Cited

U.S. PATENT DOCUMENTS

| | | | | | |
|---|---|---|---|---|---|
| 1,637,833 | A | * | 8/1927 | Mueller | 271/124 |
| 1,919,238 | A | * | 7/1933 | McCarthy | 271/119 |
| 3,291,482 | A | * | 12/1966 | Stemmler | 271/11 |
| 3,664,660 | A | * | 5/1972 | Runzi | 271/35 |
| 3,933,350 | A | * | 1/1976 | Mignano | 271/10.09 |
| 4,014,537 | A | * | 3/1977 | Stange | 271/166 |
| 4,457,507 | A | * | 7/1984 | Ishikawa et al. | 271/121 |
| 4,573,673 | A | * | 3/1986 | Haug | 271/111 |
| 4,718,809 | A | * | 1/1988 | Krasuski et al. | 414/797.7 |
| 4,720,960 | A | | 1/1988 | Green | |
| 4,991,831 | A | | 2/1991 | Green | |
| 5,062,600 | A | * | 11/1991 | Holbrook et al. | 271/35 |
| 5,143,365 | A | | 9/1992 | Green | |
| 5,192,069 | A | * | 3/1993 | Seymour et al. | 271/35 |
| 5,244,198 | A | | 9/1993 | Green | |
| 5,601,282 | A | | 2/1997 | Milo et al. | |
| 5,642,877 | A | | 7/1997 | Green | |
| 5,772,199 | A | | 6/1998 | Green | |
| 5,888,047 | A | * | 3/1999 | Auerbach et al. | 414/797.8 |
| 6,086,061 | A | | 7/2000 | Vedoy et al. | |

(Continued)

FOREIGN PATENT DOCUMENTS

| | | | | |
|---|---|---|---|---|
| DE | 3636935 | A | * | 5/1988 |
| WO | WO 8200994 | A | * | 4/1982 |

*Primary Examiner* — Luis A Gonzalez

(74) *Attorney, Agent, or Firm* — Katherine M. Scholz; Kelly, Holt & Christenson, PLLC

(57) ABSTRACT

An exemplary friction feeder includes a hopper configured to accommodate a stack of items, a drive assembly configured to engage and move an item from the stack in a feed direction, and a gate assembly. The gate assembly includes a curved elongate separating member extending in the feed direction and configured to separate the item from other items in the stack as the item passes in the feed direction. The separating member has an item engaging surface biased to a reference point.

20 Claims, 17 Drawing Sheets

(56) References Cited

U.S. PATENT DOCUMENTS

| | | | | |
|---|---|---|---|---|
| 6,402,135 | B1 | 6/2002 | Werner | |
| 6,416,047 | B1 * | 7/2002 | Pfankuch | 271/35 |
| 6,499,731 | B2 | 12/2002 | Werner | |
| 6,572,102 | B2 | 6/2003 | Vedoy | |
| 6,601,841 | B1 | 8/2003 | Werner | |
| 6,932,338 | B1 | 8/2005 | Popejoy et al. | |
| 7,303,188 | B2 * | 12/2007 | Malatesta | 271/34 |
| 7,419,154 | B2 | 9/2008 | Pelletier et al. | |
| 7,527,256 | B1 | 5/2009 | Kaiping | |
| 7,624,978 | B2 | 12/2009 | Kaiping | |
| 7,726,643 | B2 | 6/2010 | Werner | |
| 7,748,696 | B2 | 7/2010 | Kaiping | |
| 7,850,163 | B2 | 12/2010 | Kaiping | |
| 8,235,380 | B2 * | 8/2012 | Claris | 271/131 |
| 8,397,899 | B2 * | 3/2013 | Krause et al. | 198/443 |
| 2004/0051230 | A1 * | 3/2004 | Tanaka et al. | 271/121 |
| 2009/0206542 | A1 | 8/2009 | Popejoy et al. | |
| 2010/0201062 | A1 | 8/2010 | Popejoy et al. | |
| 2011/0291348 | A1 | 12/2011 | Kaiping | |

* cited by examiner

FRICTION FEEDER

CROSS-REFERENCE TO RELATED APPLICATION

The present application is based on and claims the benefit of U.S. provisional patent application Ser. No. 61/707,254, filed Sep. 28, 2012, the content of which is hereby incorporated by reference in its entirety.

BACKGROUND

There are many types of feeders for conveying sheets or other items into a process or container. An exemplary friction feeder uses a rotating belt and a separator wheel or roller spaced apart from the belt to form a nip area to shingle and separate items conveyed from a stack. In some feeders, the nip area is adjusted through a manual process of the user raising or lowering the friction wheel or roller.

The discussion above is merely provided for general background information and is not intended to be used as an aid in determining the scope of the claimed subject matter. The claimed subject matter is not limited to implementations that solve any or all disadvantages noted in the background.

SUMMARY

In one exemplary embodiment, a friction feeder includes a hopper configured to accommodate a stack of items, a drive assembly configured to engage and move an item from the stack in a feed direction, and a gate assembly. The gate assembly includes a curved elongate separating member extending in the feed direction and configured to separate the item from other items in the stack as the item passes in the feed direction. The separating member has an item engaging surface biased to a reference point.

In one exemplary embodiment, a friction feeder includes a hopper configured to accommodate a stack of items, a drive assembly configured to engage and move an item from the stack in a feed direction, and a gate assembly. The gate assembly includes a curved plate and a separating member extending from the curved plate in a feed direction and configured to separate the item from other items in the stack as the item passes in the feed direction. The curved plate is pivotable about an axis to move the separating member relative to the drive assembly.

In one exemplary embodiment, a friction feeder includes a gate assembly and a hopper configured to accommodate a stack of items. The hopper has a guide member configured to urge items in the stack toward the gate assembly. The guide member is movable in at least three degrees of freedom.

This summary is provided to introduce a selection of concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

FIGS. 5-1 and 5-2 are side elevation views of the gate assembly illustrated in FIG. 4.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The present disclosure generally relates to an apparatus for feeding or conveying materials and more specifically, but not by limitation, to a high speed friction feeder.

Figure 1:
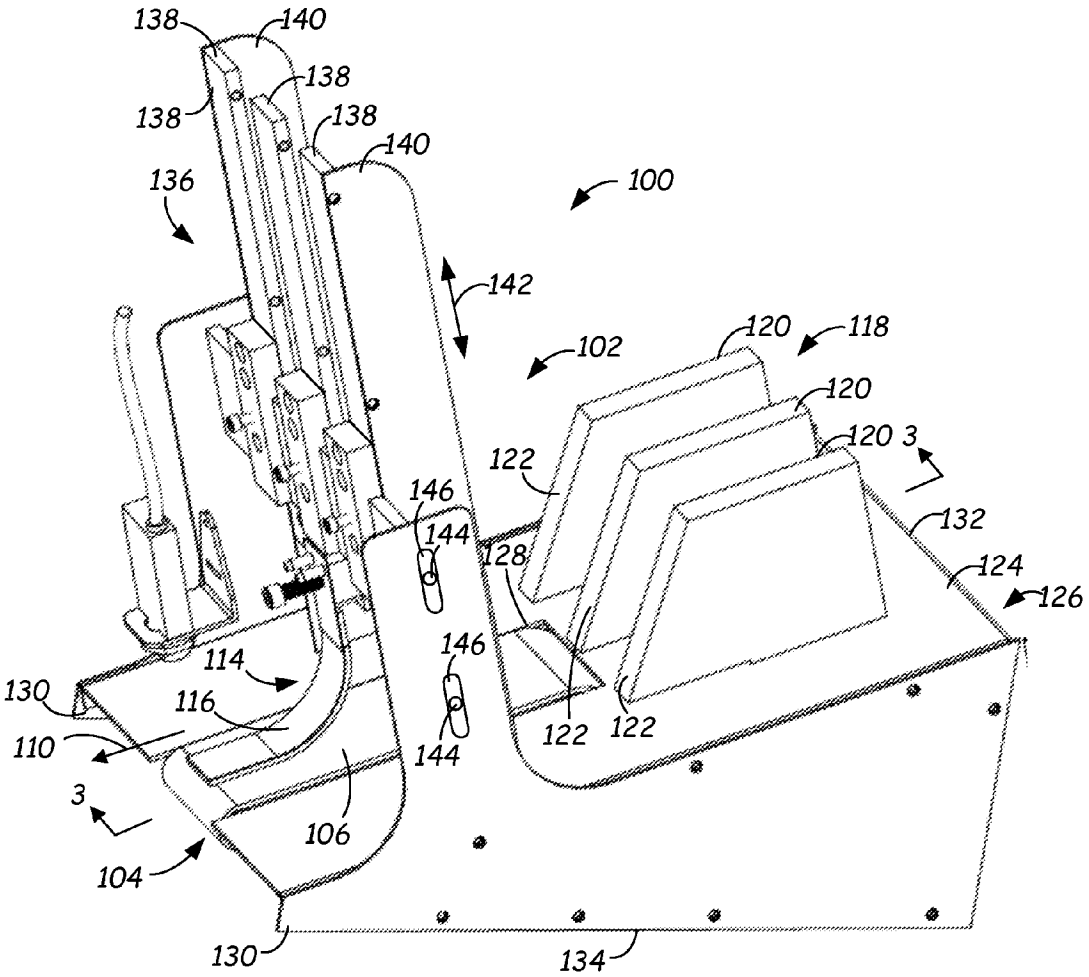
FIG. 1 is a perspective view of a feeder, under one embodiment.
Figure 2:
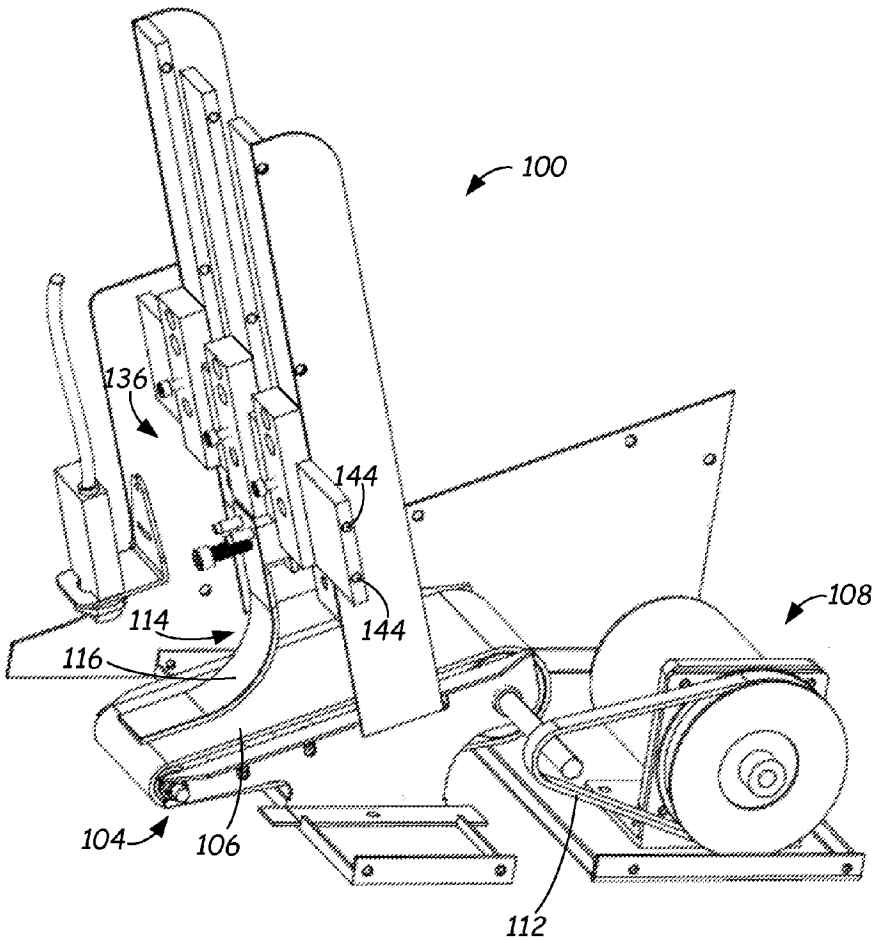
FIG. 2 is a perspective view of the feeder in FIG. 1 with some elements omitted for illustration purposes.

FIGS. 1 and 2 are perspective views of an exemplary friction feeder 100, under one embodiment. In FIG. 2, elements have been omitted for illustration purposes.

Friction feeder 100 illustratively includes a bin or hopper assembly 102 for holding a stack of items in a generally vertical position. Friction feeder 100 is configured to separate the items in the stack such that they are individually fed or conveyed into a process or a container, such as, but not limited to, envelopes. Exemplary processes include, but are not limited to, collation, labeling, and/or mailing processes.

The items in the stack can be virtually any desired material and can have the same or different thicknesses. For example, but not by limitation, the items can comprise single sheets of paper and/or multiple sheets, such as brochures, magazines, etc. In one example, the items can include greeting and novelty cards, envelopes, collapsed cartons, folded and open edge documents, tri-fold and Z-fold documents, blister cards, and/or die cuts, to name a few. Friction feeder 100 can also feed non-paper based items, such as plastic cards, cassettes, etc. Friction feeder 100 is configured to handle items of varying thicknesses without requiring user intervention to adjust components of friction feeder 100.

Illustratively, feeder 100 is configured to convey materials at high speeds greater than or equal to 100 feet per minute (ft/min). In one particular example, a high speed feeder conveys material at more than 200 ft/min. In another example, a high speed feeder conveys material at more than 300 ft/min. Of course, feeder 100 can be configured to convey materials at speeds less than 100 feet per minute.

In the illustrated embodiment, friction feeder 100 includes a drive assembly 104 having a conveying belt 106 configured to engage a surface of a bottom item in hopper 102. Belt 106 is rotated by a motor 108 and is formed of material having sufficient friction characteristics such as, but not limited to, urethane, natural gum rubber, composite gum rubber, and/or other elastomers to move the bottom item in a forward feed direction 110. Belt 106 is driven by motor 108 using a timing belt 112. Alternatively, or in addition, drive assembly 104 can include friction drive wheels or other suitable mechanisms configured to engage and move the items from the stack.

Friction feeder 100 includes a gate assembly 114 having a separating member 116 that engages items in the stack and is configured to separate the bottom item being conveyed by belt 106 in forward direction 110 from the other items in the stack. Hopper 102 includes a guide assembly 118 that biases the items toward separating member 116. Illustratively, guide assembly 118 includes one or more wedge members 120 having an item engaging surface 122. Surface 122 can be any suitable shape including planar and/or curved portions.

Guide assembly 118 is positioned on a top plate 124 of a housing 126. Top plate 124 defines an opening 128 that accommodates belt 106. Housing 126 also includes side plates 130 and a rear plate 132 defining a space therein that accommodates drive assembly 104 and motor 108. Top plate 124 is oriented at an angle with respect to a bottom surface 134 of housing 126.

A support assembly 136 is mounted between side plates 130. In the illustrated embodiment, assembly 136 supports gate assembly 114, as well as one or more forward plates 138 and side plates 140 for hopper 102. Assembly 136 is movable in directions represented by double arrow 142 (shown in FIG. 1) to adjust its position relative to top plate 124. In this manner, a position of gate assembly 114 relative to belt 106 can be adjusted by a user, if desired. In one embodiment, apertures 144 of assembly 136 are configured to receive corresponding fasteners (not shown in FIGS. 1 and 2), such as screws, and are aligned with slots 146 formed on side plates 130.

Figure 3:
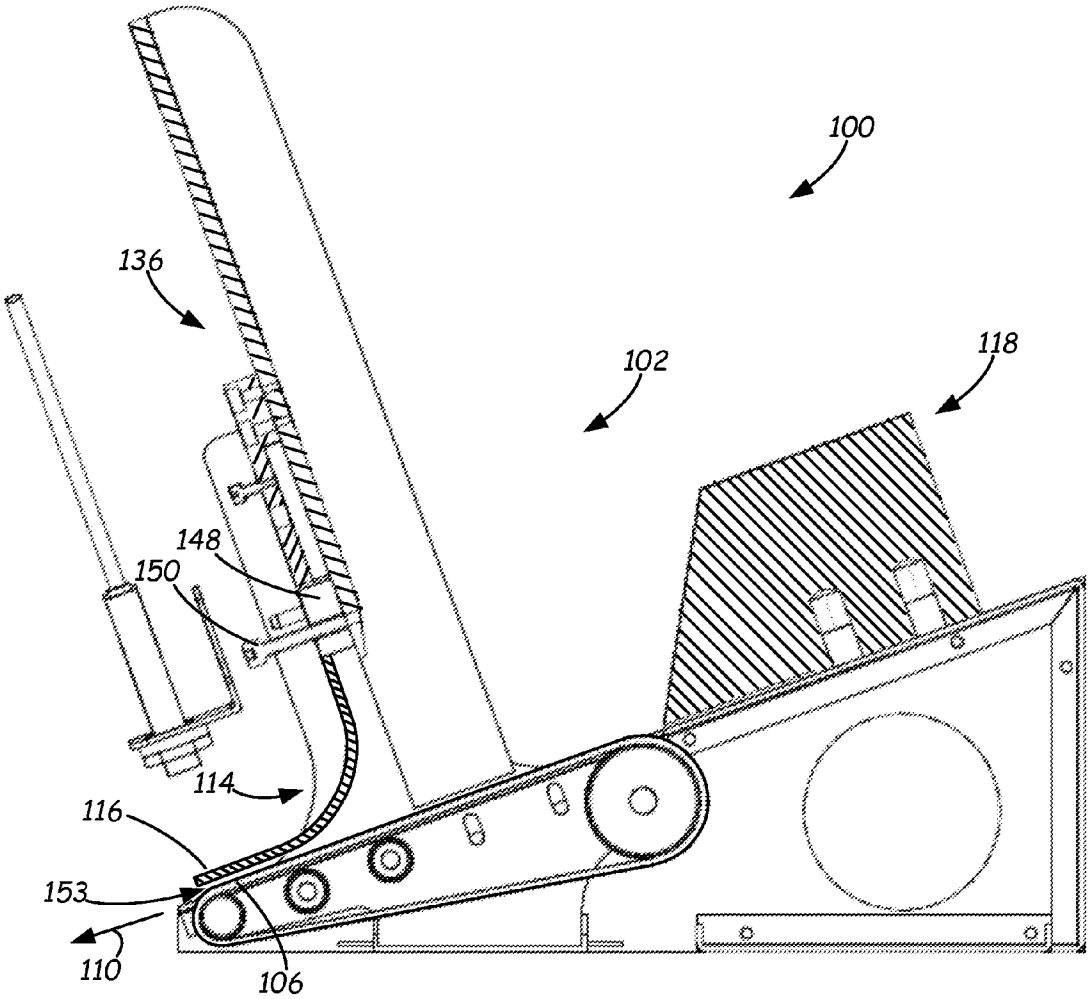
FIG. 3 is a side sectional view of the feeder illustrated in FIG. 1 taken at line 3-3.
Figure 4:
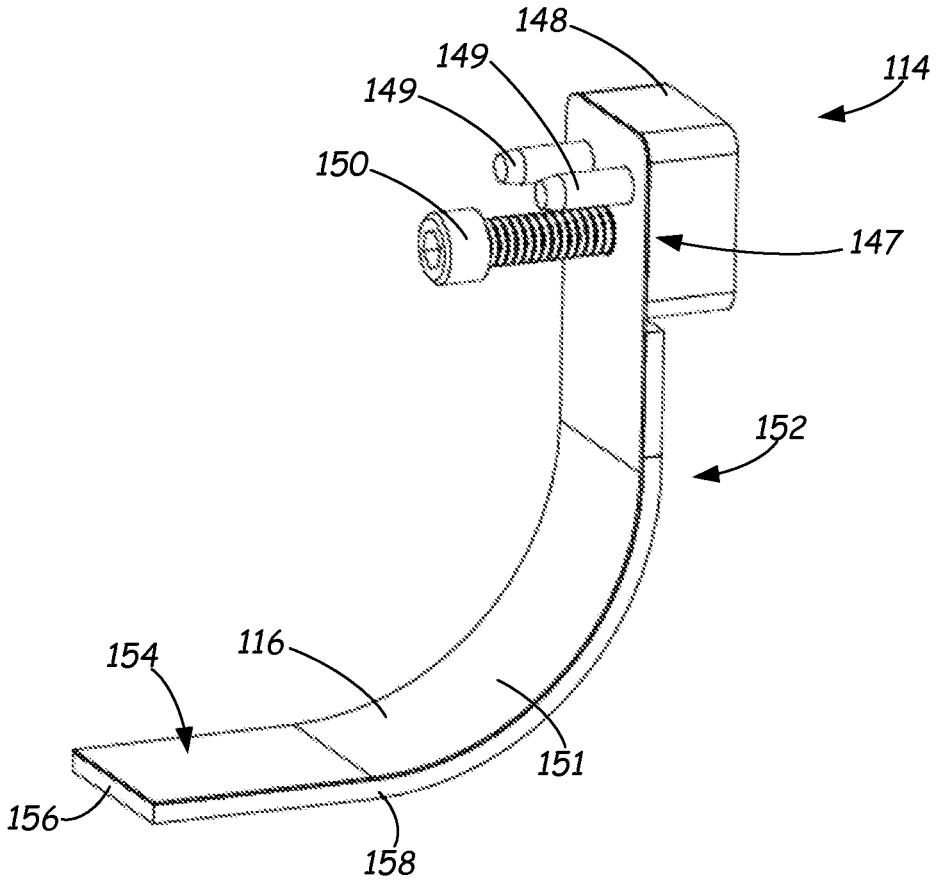
FIG. 4 is a perspective view of a gate assembly, under one embodiment.
Figures 1, 5:
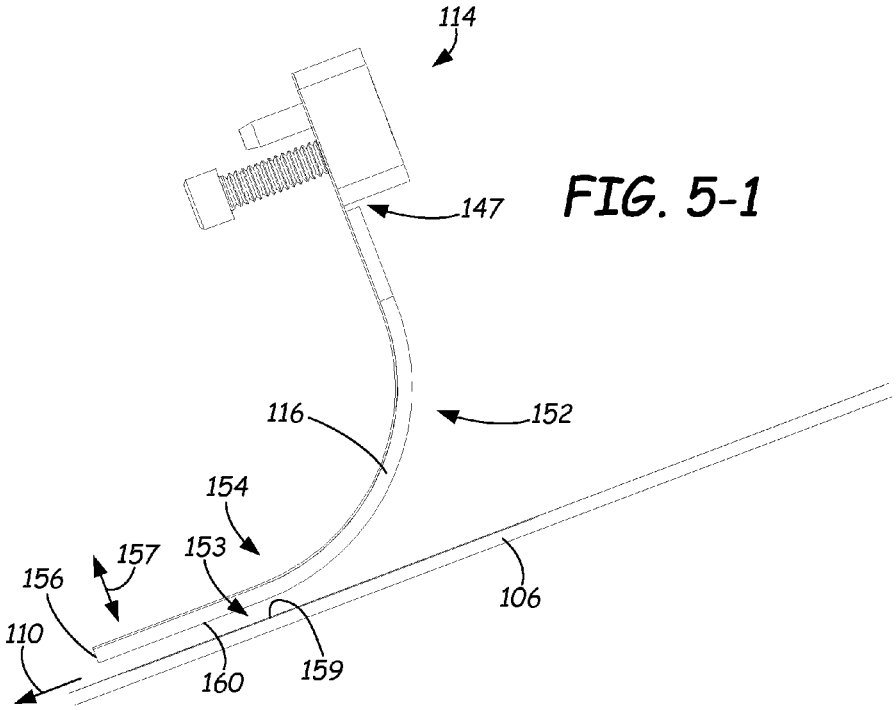
Figures 2, 5:
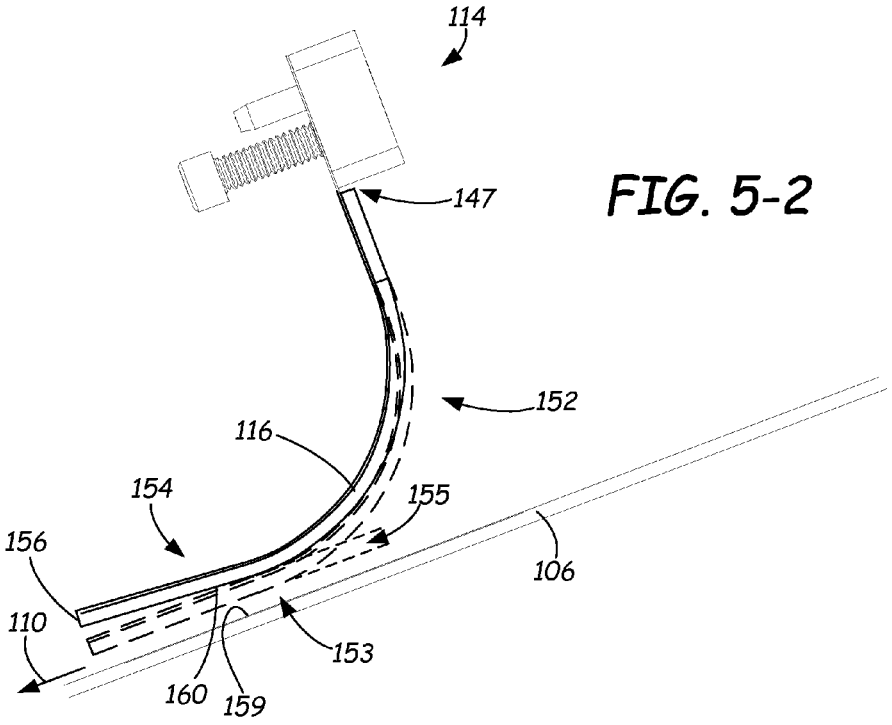

FIG. 3 is a side sectional view of friction feeder 100 at line 3-3 shown in FIG. 1. FIG. 4 is a perspective view illustrating gate assembly 114 in further detail. FIGS. 5-1 and 5-2 are side elevation views illustrating separating member 116 in a neutral, non-flexed position (FIG. 5-1) and a flexed position (FIG. 5-2). The neutral, non-flexed position of FIG. 5-1 is illustrated by phantom lines in FIG. 5-2.

In the illustrated embodiment, separating member 116 has a first pre-gate portion 152 and a second main gate portion 154. Pre-gate portion 152 is configured to engage and pre-shingle the items as they are urged forward by guide assembly 118, prior to entering a nip area 153, to reduce the frictional bond between adjacent items. The nip area 153 is defined between an item engaging surface 159 of conveying belt 106 and an item engaging surface 160 of the main gate portion 154.

The item engaging bottom surface 160 of separating member 116 has sufficient friction characteristics to enable the shingling of the items as they pass through gate assembly 114. In one embodiment, separating member 116 is formed of a material having suitable friction characteristics. In the illustrated embodiment, separating member 116 comprises a friction pad 158 positioned on a base assembly or layer 151. Friction pad 158 is formed of a material such as but not limited to, urethane or other elastomers. Friction pad 158 extends along at least a portion of base layer 151 and can be located on both pre-gate portion 152 and main gate portion 154. Friction pad 158 can be attached to base layer 151 using any suitable fastening means, such as an adhesive. In one embodiment, separating member 116 can be coated with an elastomer, or other suitable material, through a dipping process.

Separating member 116 has a first end 147 supported on gate assembly 114 in a substantially static position and extends in the forward direction 110. For example, gate assembly 114 illustratively includes a mounting block 148 that is coupled to support assembly 136 using a fastening device, such as a pins 149 and/or a screw 150.

A second end 156 of separating member 116 is movable relative to the item engaging surface 159 of belt 106 (represented by double arrow 157 shown in FIG. 5-1) which adjusts nip area 153. The item engaging surface 160 is biased to a reference point. In one example, the reference point to which separating member 116 is biased can cause contact with belt 106. In another example, surface 160 is spaced apart from belt 106 when separating member 116 is in a neutral position.

In the illustrated embodiment, separating member 116 is flexible to some degree allowing the second end 156 to move away from belt 106 as items passing through nip area 153 engage surface 160. In FIG. 5-2, a distance 155 represents movement of the surface 160 at nip area 153 relative to the first end 147 as an item is fed through nip area 159. Separating member 116 is illustratively configured to flex a distance 155 greater than one tenth of an inch. In one example, separating member 116 is configured to flex a distance 155 greater than one quarter of an inch. In another example, separating member 116 is configured to flex a distance 155 greater than one half an inch.

This flexibility allows separating member 116 to accommodate items of varying thickness. Further, due to the resilient biasing force of separating member 116 a downward pressure is applied by main gate portion 154 on the items as they pass through nip area 153, which allows the bottom item in the stack to travel through nip area 153 while retarding other items in the stack. Each item dispensed from hopper 102 passes through nip area 153, one at a time, as they are sequentially pulled from the bottom of the stack by belt 106 such that they are shingled as they are conveyed away from the stack.

In one example, base layer 151 is formed by a flexible, cantilevered piece of spring steel having curved pre-gate portion 152 and elongated main gate portion 154 with a sufficient length that applies pressure out to end 156. In another example, base layer 151 can be formed of a plastic or other polymer.

In one example, main gate portion 154 is substantially planar and surface 160 is substantially parallel to belt 106 in the neutral, non-flexed state. In another example, bottom surface 160 can form an angle with respect to belt 106 such that a gap between belt 106 and bottom surface 160 becomes smaller along the forward direction 110.

Alternatively, or in addition, separating member 116 can include a hinged joint and a separate biasing mechanism configured to apply a downward force on main gate portion 154. For example, a compression spring can be positioned near end 156 and configured to apply a force on main gate portion 154 toward belt 106. In another example, magnets can be utilized to magnetically attract main gate portion 154 toward belt 106.

Exemplary separating member 116 is illustratively formed inexpensively and has a simple installation and removal processes. Separating member 116 can therefore be considered disposable. Thus, if the friction surface (e.g., friction pad 158) of separating member 116 wears out, the user just discards separating member 116 and installs a new one.

In one embodiment, gate assembly 114 does not require adjustment mechanisms to set a thickness of the items to be fed. Rather, as items of varying thickness are fed from hopper 102 through gate assembly 114, separating member 116 flexes to accommodate the varying thicknesses while applying an adequate biasing force against the items to separate and shingle them as they pass through gate assembly 114. In this manner, the nip area 153 between main gate portion 154 and belt 106 automatically changes as a result of the flexing of separating member 116.

In one example, but not by limitation, items having thicknesses from near zero to one quarter inch can be intermixed in hopper 102 and separated by gate assembly 114. In another example, gate assembly 114 can separate items having thickness variations of one half inch or greater without requiring any height adjustment of gate assembly 114. However, it is noted that these item thicknesses, and the illustrated curve of pre-gate portion 152 and the angle of main gate portion 154 with respect to belt 106, are exemplary and are not intended to limit the scope of the concepts described herein.

Figure 6:
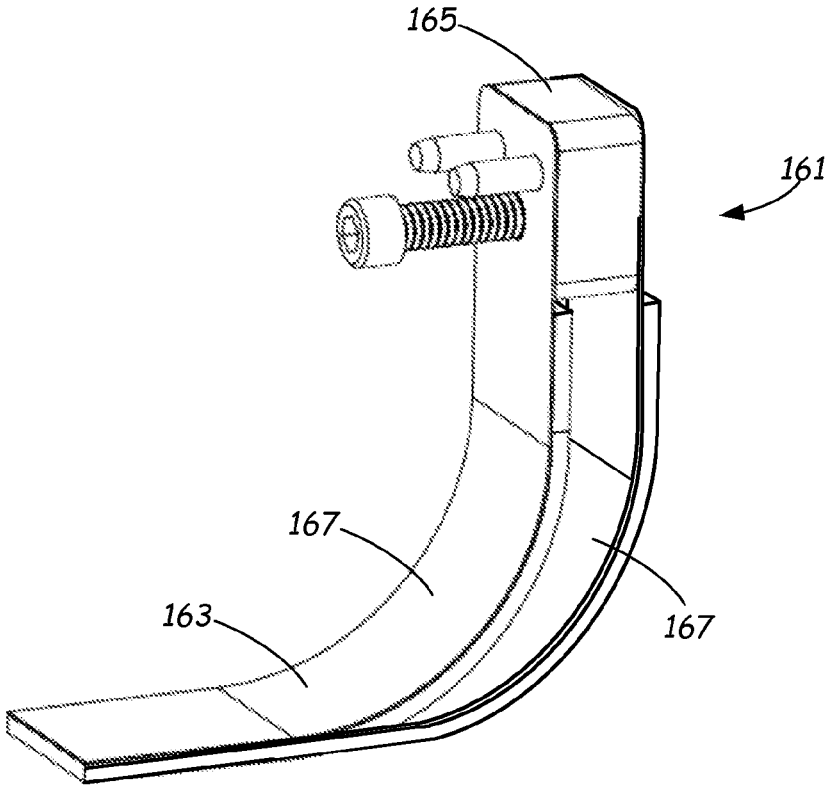
FIG. 6 is a perspective view of a gate assembly, under one embodiment.

FIG. 6 illustrates one embodiment of a gate assembly 161 having a curved elongate separating member 163 extending from a mounting block 165. Separating member 161 has a pair of flexible layers 167 that are spaced apart at a first end and attached at a second end.

Figure 7:
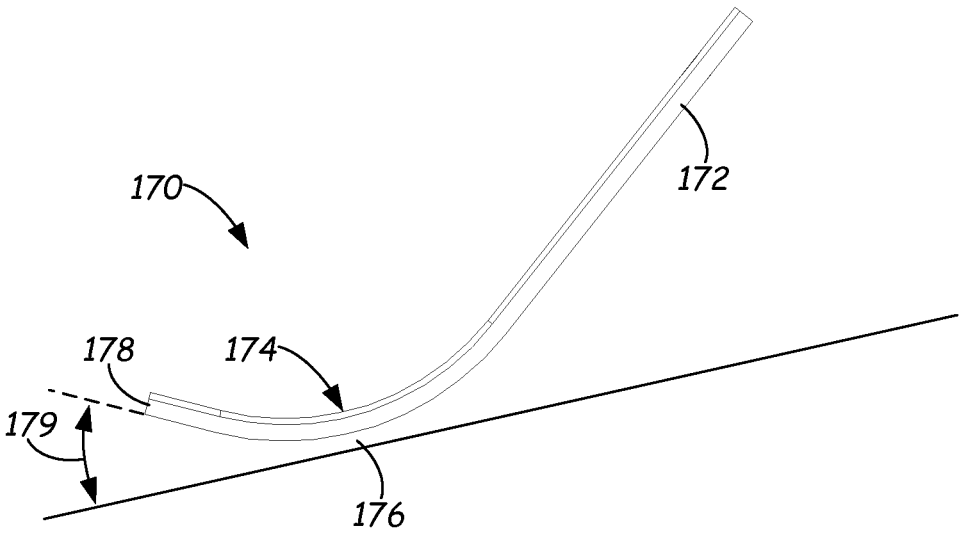
FIG. 7 is a side elevation view of a separating member, under one embodiment.

FIG. 7 illustrates one embodiment of a curved elongate separating member 170 having a pre-gate portion 172 and a main gate portion 174 forming a nip area 176. The main gate portion 174 has a curvature such that an end 178 is oriented at an angle 179 with respect to an item engaging surface of a conveyor, such as a conveying belt.

Figure 8:
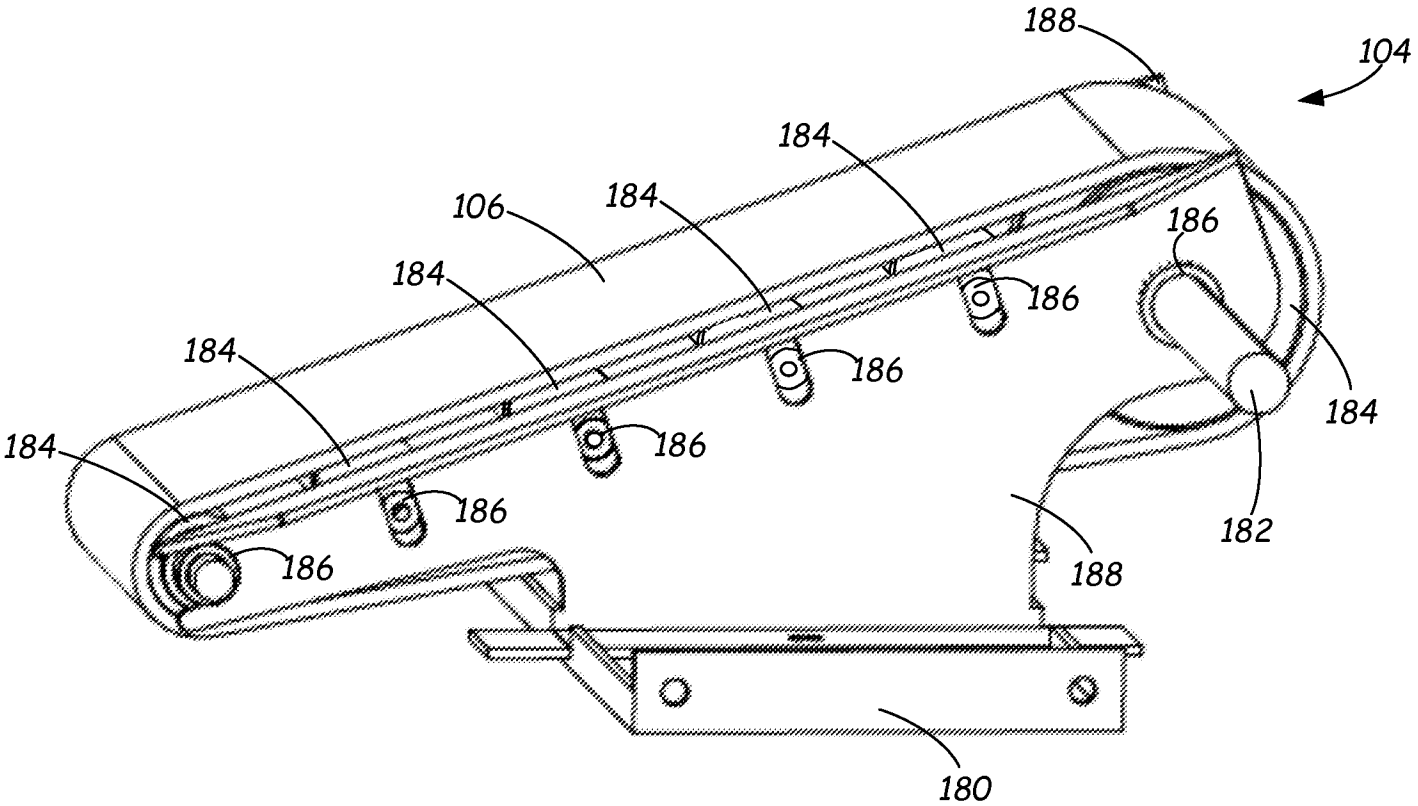
FIG. 8 is a perspective view of a modular drive assembly, under one embodiment.

FIG. 8 illustrates one embodiment of drive assembly 104. Drive assembly 104 comprises a modular unit configured for easy installation and removal from housing 126, as illustrated in FIG. 2. By way of example, during the course of normal operation, a drive assembly belt 106 may wear such that replacement of belt 106 is necessary. To remove the modular drive assembly 104, a user opens housing 126 and disengages timing belt 112 from a drive shaft 182. One or more fasteners (not shown in FIG. 2 or 8) used to secure drive assembly 104 in housing 126 are removed, thereby permitting the modular unit to be removed from housing 126. For example, assembly 104 has a base 180 that is secured to a base and/or side plates of housing 126. Drive assembly 104 includes belt 106 positioned on rotating wheels 184 mounted between side plates 188. Side plates 188 support bearings 186 on which wheels 184 rotate.

Figure 9:
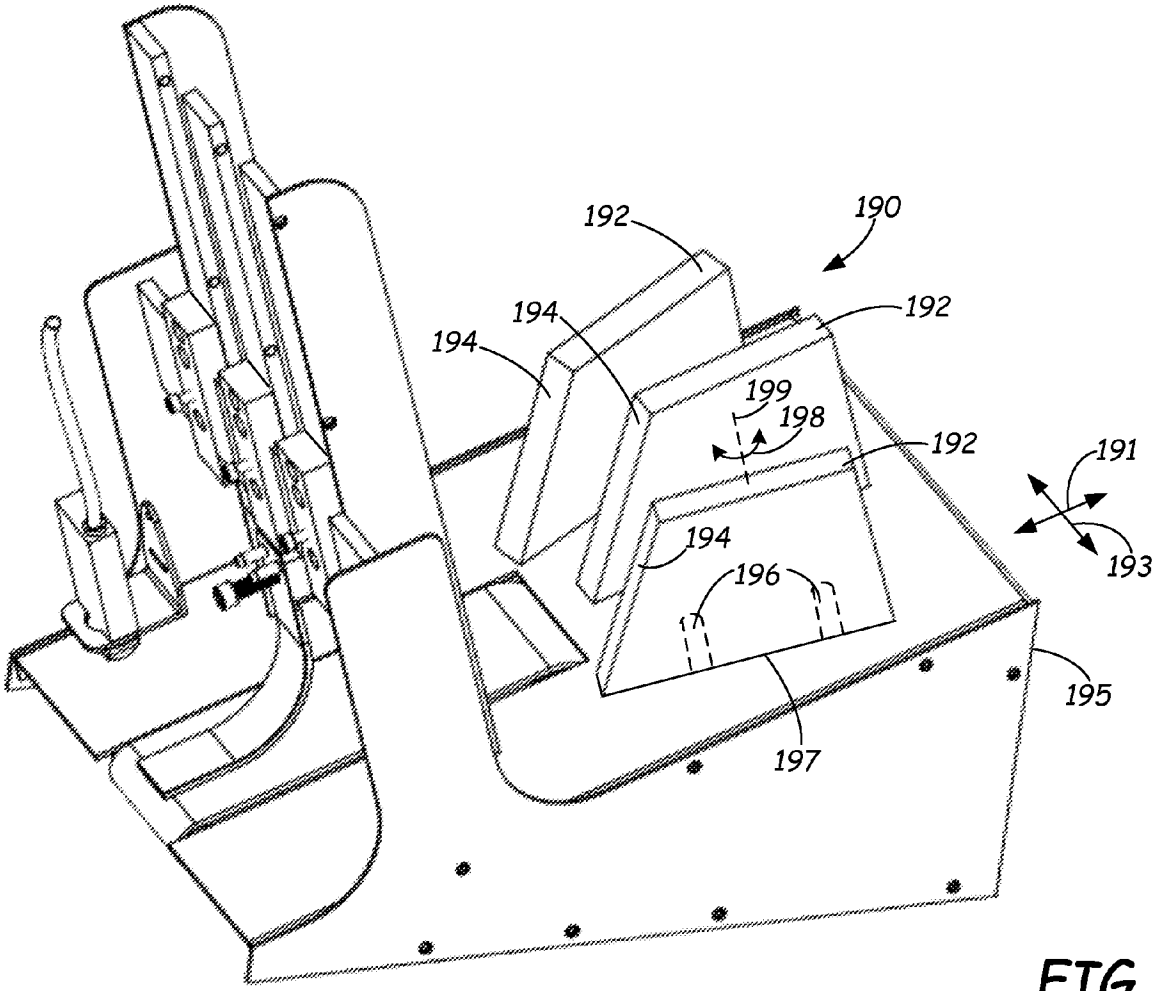
FIG. 9 is a perspective view of a feeder having a guide assembly, under one embodiment.

FIG. 9 illustrates one embodiment of a guide assembly 190 having one or more movable wedge members 192. While three wedge members 192 are illustrated, less than or more than three can be utilized. Each wedge member 192 has a forward face 194 configured to engage and urge items towards a gate assembly. The item engaging surfaces 194 can have planar and/or curved portions.

The wedge members 192 are movable in at least three degrees of freedom thereby enabling a user to individually place the wedge members 192 in a plurality of different orientations to accommodate items of different sizes and shapes. Illustratively, each wedge member 192 can be moved in first directions 191 toward or away from the gate assembly as well as laterally in second directions 193. Each wedge member 192 can also be rotated (illustrated by arrow 198) about an axis 199. In this manner, each wedge member 192 can be moved independently of other ones of the wedge members 192.

In the illustrated embodiment, each wedge member 192 includes one or more magnets positioned along a bottom surface 197 that interact with the surface of housing 195, which is illustratively formed of suitable metal. Exemplary magnets 196 in a wedge member 192 are illustrated in phantom in FIG. 9. In one example, magnets 196 are positioned in bores formed in bottom surface 197.

Figure 10:
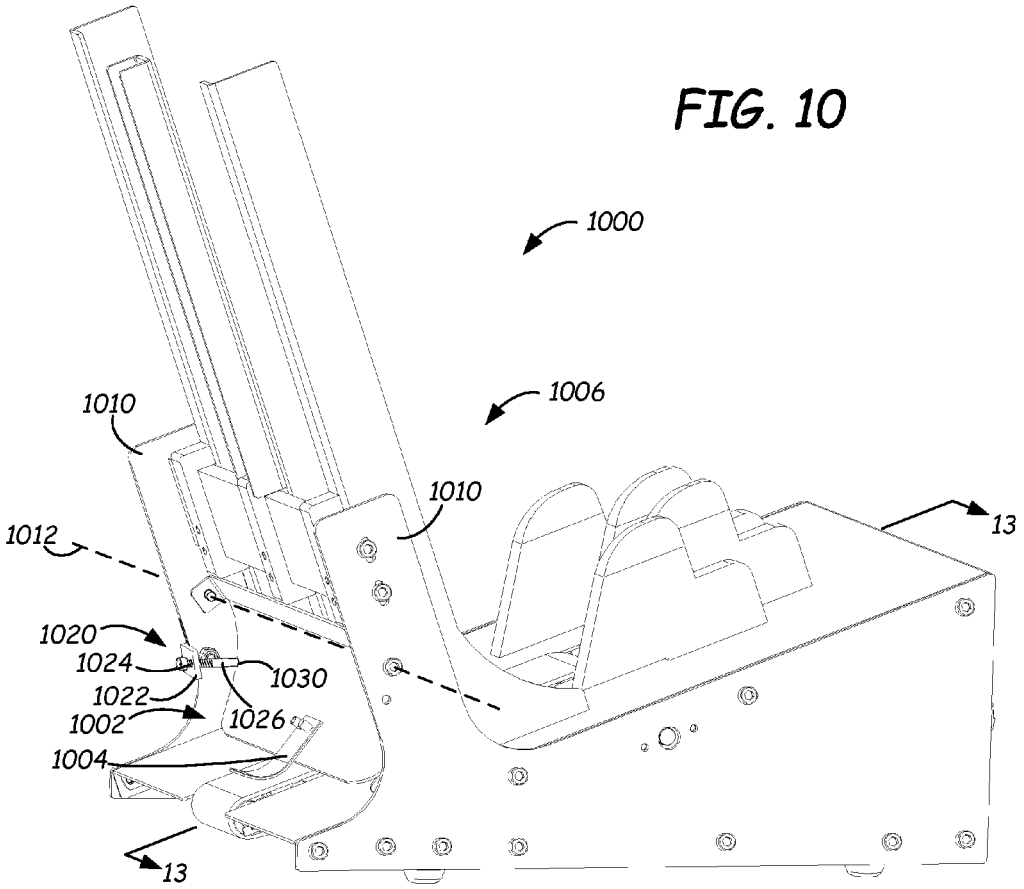
FIG. 10 is a perspective view of a feeder, under one embodiment.
Figure 11:
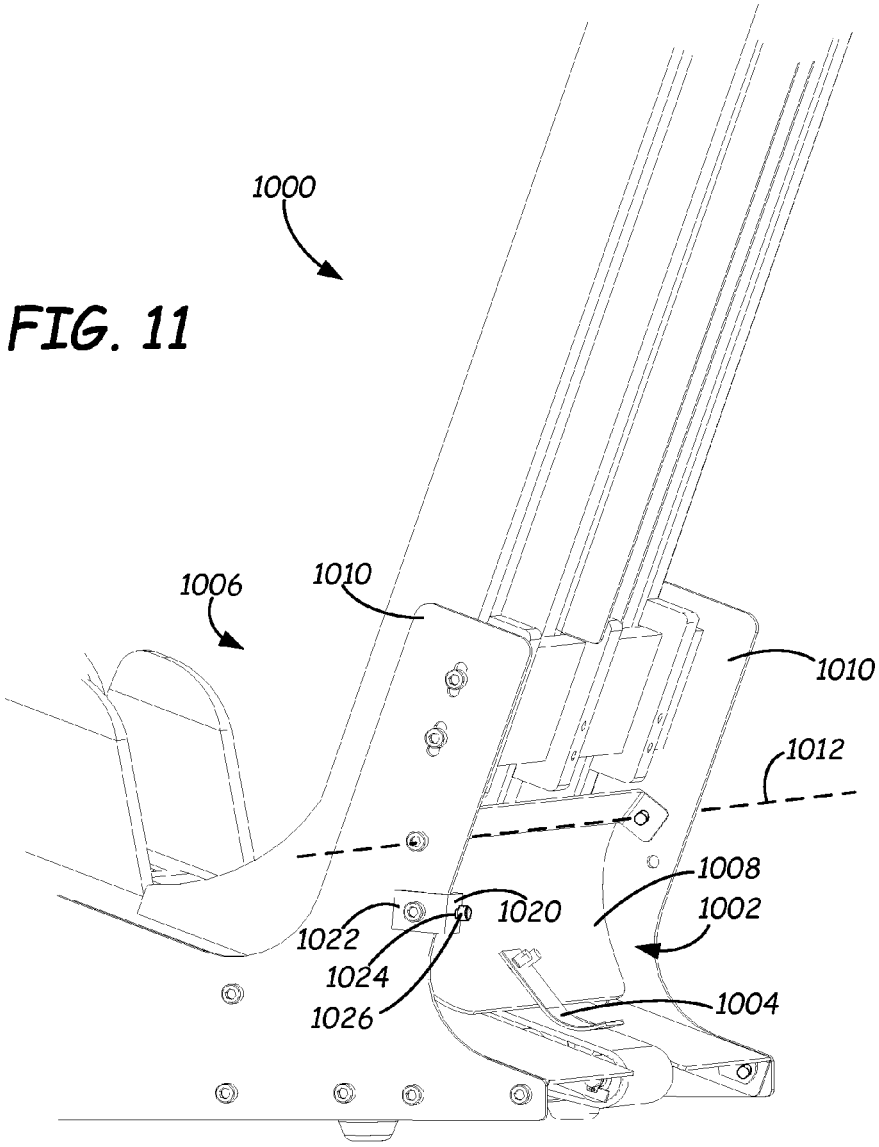
FIG. 11 is an enlarged perspective view of the feeder illustrated in FIG. 10.

FIG. 10 is a perspective view illustrating one embodiment of a friction feeder 1000. Feeder 1000 includes a gate assembly 1002 having a separating member 1004. FIG. 11 is a perspective view of feeder 1000 showing gate assembly 1002 in further detail.

As illustrated, gate assembly 1002 comprises one or more pre-gate features configured to engage and pre-shingle the items as they travel from hopper 1006. The pre-gate features illustratively comprise a curved plate 1008 that is pivotally supported on feeder 1000. In one example, curved plate 1008 is supported between side plates 1010 and is configured to rotate about an axis 1012. Separating member 1004 is attached to and supported by plate 1008

Figure 12:
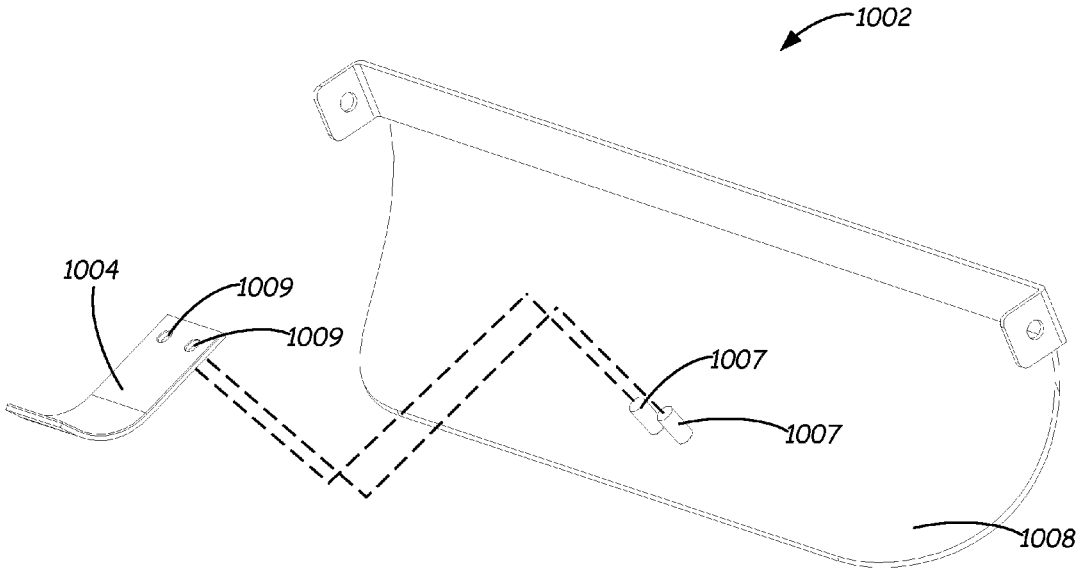
FIG. 12 is an exploded view of a gate assembly, under one embodiment.

FIG. 12 is an exploded view of gate assembly 1002, under one embodiment. Curved plate 1008 comprises a pair of protrusions or pins 1007. A corresponding pair of apertures 1009 on separating member 1004 are configured to receive pins 1007 to locate separating member 1004 on curved plate 1008. In one example, pins 1007 are threaded to receive a fastener such as a nut to secure separating member 1004 on plate 1008.

Figure 13:
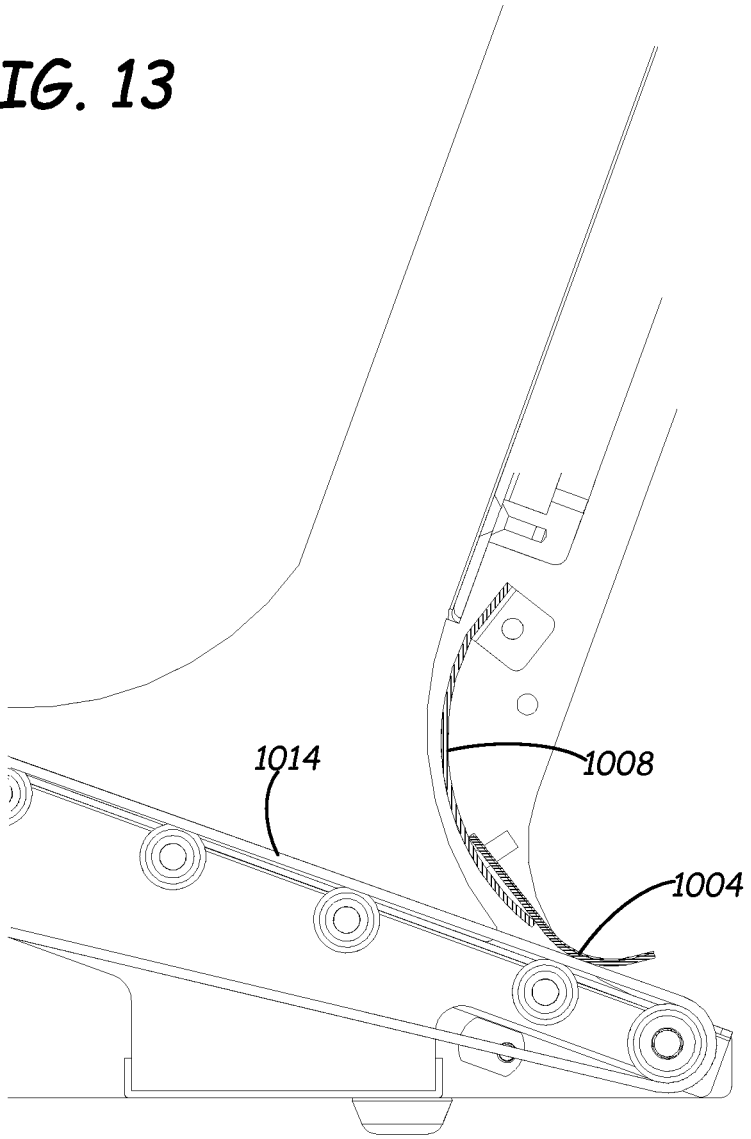
FIGS. 13 and 14 are side sectional views of the feeder illustrated in FIG. 10 taken at line 13-13.
Figure 14:
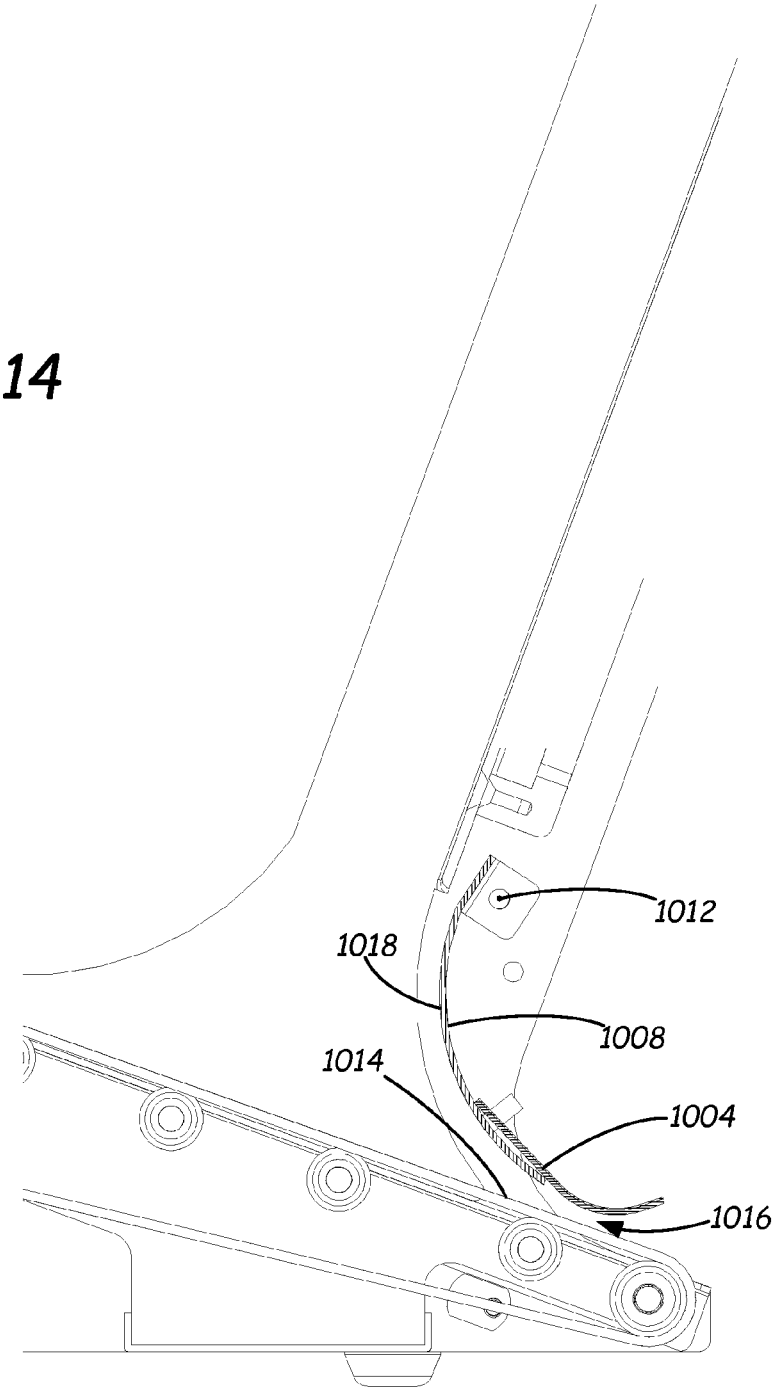

FIGS. 13 and 14 are side sectional views taken at line 13-13 in FIG. 10. FIG. 13 illustrates plate 1008 in a first rotational position and FIG. 14 illustrates plate 1008 in a second rotational position. As shown, rotation of plate 1008 about axis 1012 changes the pre-shingling angle and moves separating member 1004 relative to conveying belt 1014 to adjust the nip area 1016. In one example, separating member 1004 is similar to separating member 114 illustrated in FIG. 4. In the illustrated example, separating member 1004 is similar to separating member 170 illustrated in FIG. 7.

While the item engaging surface 1018 of plate 1008 is illustrated as substantially curved, is noted that in other examples plate 1008 can be substantially planar. In another example, portions of plate 1008 can be curved while other portions are planar.

Referring again to FIGS. 10 and 11, in one example an adjustment feature 1020 is provided allowing for user adjustment of the rotational position of plate 1008. Illustratively, feature 1020 comprises a bracket 1022 attached to a side plate 1010. Bracket 1022 has an aperture 1024 that receives a bolt 1026. Bolt 1026 is threadably received in aperture 1024 such that rotation of bolt 1026 moves it relative to plate 1008. An end 1030 of bolt 1026 engages plate 1008 and causes rotation of plate 1008 as bolt 1026 moves through aperture 1024.

In one example, plate 1008 can be spring loaded towards feature 1020 such that plate 1008 rotates as bolt 1026 is retracted away from plate 1008. In another example, end 1030 can be attached to plate 1008 using a suitable assembly such that bolt 1026 pulls plate 1008 upon threading bolt 1026 through bracket 1022.

Figure 15:
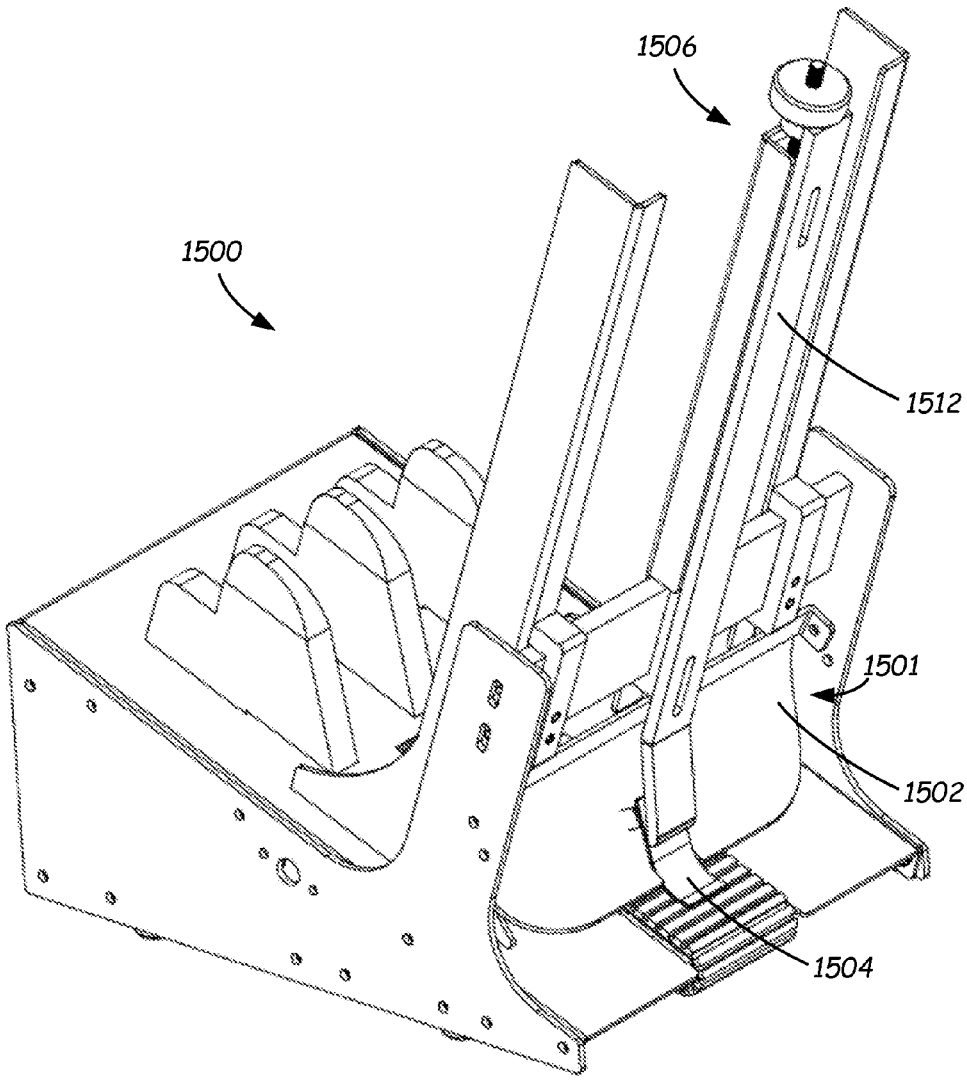
FIG. 15 is a perspective view of a feeder, under one embodiment.
Figure 16:
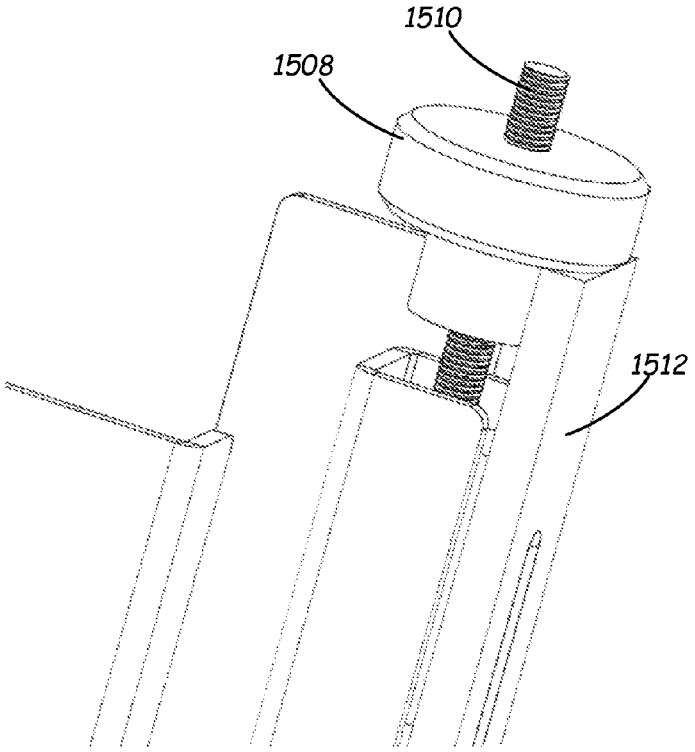
FIG. 16 is an enlarge perspective view of a portion of the feeder illustrated in FIG. 15.
Figure 17:
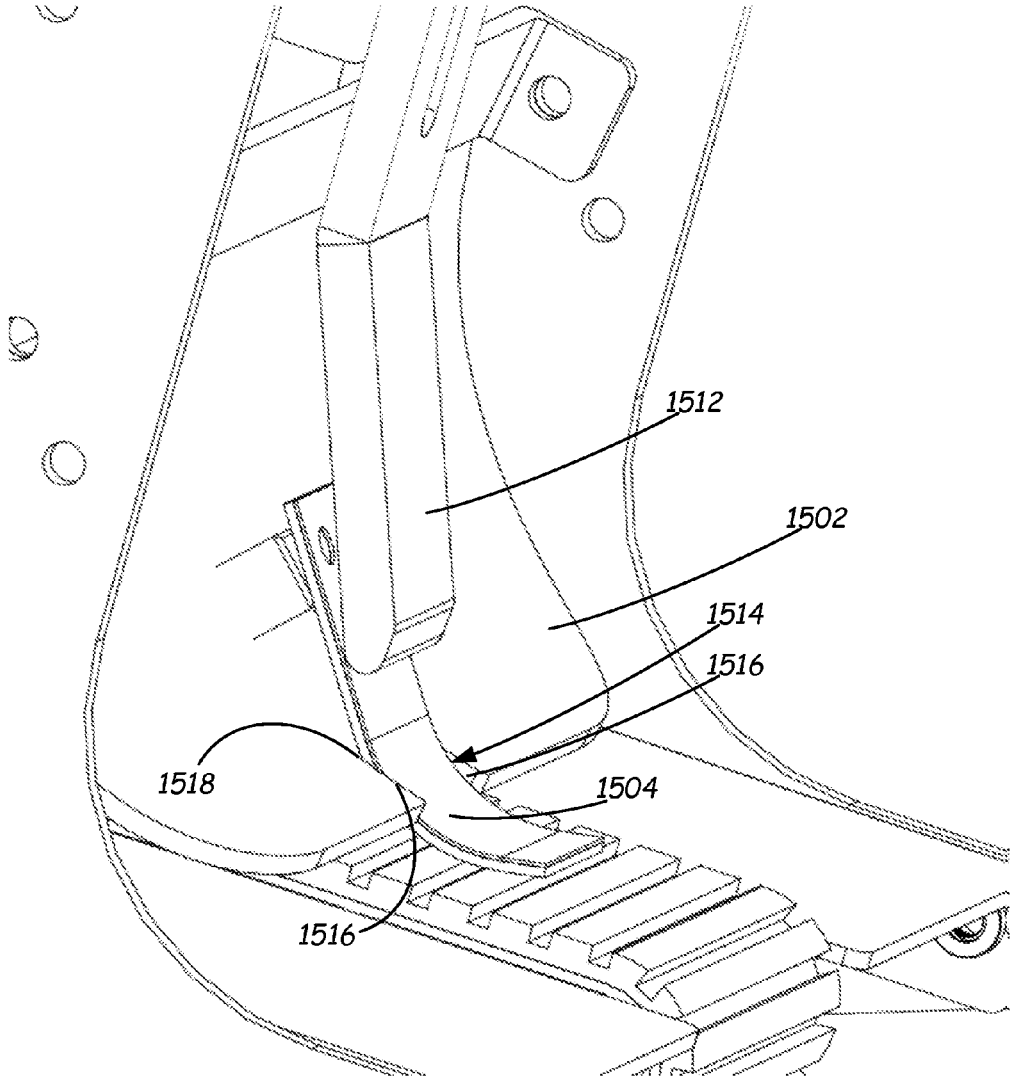
FIG. 17 is an enlarge perspective view of a portion of the feeder illustrated in FIG. 15.

FIG. 15 is a perspective view of a feeder 1500, under one embodiment. FIGS. 16 and 17 are enlarge perspective views of portions of feeder 1500.

In the illustrated embodiment, feeder 1500 includes a gate assembly 1501 comprising a curved plate 1502 that is pivotally supported on feeder 1500. A separating member 1504 is attached to and supported by plate 1502. An adjustment assembly 1506 is configured to adjust the rotational position plate 1502.

As shown in FIG. 16, adjustment assembly 1506 includes a knob 1508 that is positioned on a threaded shaft 1510. Rotation of knob 1508 causes vertical movement of knob 1508 along shaft 1510. Knob 1508 has a surface that engages a first end of an elongated bar 1512. A second end of bar 1512 is configured to engage gate assembly 1501. In the illustrated embodiment, bar 1512 contacts separating member 1504. However, in another embodiment bar 1512 can be configured to contact plate 1502 and/or another portion of gate assembly 1501.

Bar 1512 is configured to push downwardly on gate assembly 1501 as knob 1508 is rotated on shaft 1510, thereby causing rotation of plate 1502. As knob 1508 is threaded in an opposite direction, bar 1512 moves upwardly as a result of an attachment to knob 1508 and/or a biasing force on plate 1502 (such as by a spring).

In the illustrated embodiment, plate 1502 includes a recess 1514 that accommodates separating member 1504. Illustratively, but not by limitation, recess 1514 comprises a pair of walls 1516 that are spaced apart by a width that is slightly larger than a width of separating member 1504. Further, a surface 1518 of plate 1502 that forms recess 1514 can be configured to engage separating member 1504.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A friction feeder comprising:

a hopper configured to accommodate a stack of items;

a drive assembly configured to engage and move an item from the stack in a feed direction;

a gate assembly comprising a curved, cantilevered elongate separating member connected to a curved plate configured to pivot about an axis, wherein the separating member extends in the feed direction and is configured to separate the item from other items in the stack as the item passes in the feed direction, wherein the separating member has an item engaging surface biased to a reference point, and wherein the separating member comprises a pre-gate portion and elongated main gate portion, and wherein the separating member is configured to flex to accommodate the stack of items; and a guide assembly disposed to bias the items toward the separating member.

2. The friction feeder of claim 1, wherein the separating member is flexible such that the item engaging surface of the separating member moves relative to the drive assembly as an item passes through a nip area formed between the separating member and the drive assembly.

3. The friction feeder of claim 2, wherein the separating member has a first end that is supported by the gate assembly and a second end that is movable relative to an item engaging surface of the drive assembly due to flexing of the separating member to adjust the nip area formed between the item engaging surfaces of the separating member and drive assembly.

4. The friction feeder of claim 1, wherein the separating member comprises a first pre-gate portion and a second main gate portion.

5. The friction feeder of claim 4, wherein the pre-gate portion is substantially curved and the main gate portion is substantially planar.

6. The friction feeder of claim 4, wherein the separating member comprises a friction pad on at least the main gate portion.

7. The friction feeder of claim 6, wherein the pre-gate and main gate portions are formed of spring steel and the friction pad is formed of an elastomer.

8. The friction feeder of claim 1, and further comprising an adjustment assembly configured to adjust the rotational position of the curved plate.

9. The friction feeder of claim 8, wherein the gate assembly is pivotably attached to the support assembly.

10. The friction feeder of claim 1, and further comprising a motor disposed within a housing, wherein the drive assembly comprises a modular unit having a belt that is removably engageable to the motor within the housing.

11. A friction feeder comprising:

a hopper configured to accommodate a stack of items;

a drive assembly configured to engage and move an item from the stack in a forward direction;

a gate assembly comprising:

a curved plate, wherein the curved plate comprises a first edge that is configured to pivot about an axis extending perpendicular to the forward direction, such that the curved plate rotates a second edge along the feed direction; and a cantilevered separating member extending from the curved plate in a forward direction and configured to separate the item from other items in the stack by engaging the item such that, as the item passes in the forward direction, the curved plate being pivotable about an axis to move the separating member relative to the drive assembly; and a guide assembly disposed to bias the items toward the separating member.

12. The friction feeder of claim 11, wherein the curved plate is configured to reduce the frictional bond between items in the stack by pre-shingling the items prior to entering a main gate formed by the separating member.

13. The friction feeder of claim 11, wherein the curved plate is pivotably supported on a support assembly.

14. The friction feeder of claim 13, wherein the curved plate is disposed adjacent to a support bracket of the support assembly.

15. The friction feeder of claim 12, wherein the separating member has a first end supported on the curved plate.

16. The friction feeder of claim 15, wherein the separating member has a second end that is movable relative to an item engaging surface of the drive assembly due to flexing of the separating member to adjust a nip area formed between the item engaging surfaces of the separating member and drive assembly.

17. A friction feeder comprising:

a gate assembly comprising an elongated, curved, cantilevered separating member connected to a curved plate pivotably supported on the friction feeder such that the curved plate pivots on an axis that is perpendicular to a feed direction; and a hopper configured to accommodate a stack of items, the hopper having a guide member positioned such that it biases the stack of items toward the gate assembly and wherein the guide member is configured to urge items in the stack toward the gate assembly such that they are biased toward the separating member, the guide member being movable in at least three degrees of freedom.

18. The friction feeder of claim 17 and further comprising a housing having a top surface, wherein the guide member is movable in a direction that is parallel to the top surface and rotatable about an axis that is substantially perpendicular to the to surface.

19. The friction feeder of claim 17, and comprising a plurality of independently movable guide members.

20. The friction feeder of claim 17, wherein the guide member comprises at least one magnet configured to resist movement of the guide member along the top surface.

* * * * *

UNITED STATES PATENT AND TRADEMARK OFFICE

CERTIFICATE OF CORRECTION

PATENT NO. : 9,221,629 B1
APPLICATION NO. : 13/835412
DATED : December 29, 2015
INVENTOR(S) : Steven G. Sands and Joseph R. Lacher It is certified that error appears in the above-identified patent and that said Letters Patent is hereby corrected as shown below:

In the claims

Claim 9:
Column 8, Lines 20-21:

remove "wherein the gate assembly is pivotably attached to the support assembly." and replace with "and further comprising an elongated bar configured to engage the gate assembly and cause the curved plate to rotate."

Claim 18:
Column 9, Line 12:

"to" should be replaced with "top"

Signed and Sealed this
Fifth Day of July, 2016

Michelle K. Lee

Michelle K. Lee
*Director of the United States Patent and Trademark Office*